United States Patent [19]

Watanabe et al.

[11] 3,937,628

[45] Feb. 10, 1976

[54] SOLID-SOLUTION STRENGTHENED AUSTENITIC ALLOYS

[75] Inventors: Rikizo Watanabe; Yositaka Chiba, both of Yasugi, Japan

[73] Assignee: Hitachi Metals, Ltd., Japan

[22] Filed: Apr. 3, 1974

[21] Appl. No.: 457,501

[30] Foreign Application Priority Data

May 30, 1973 Japan ..... 48-65766

[52] U.S. Cl. ..... 75/134 F; 75/171

[51] Int. Cl.[2] ..... C22C 19/00

[58] Field of Search ..... 75/134 F, 171

[56] References Cited

UNITED STATES PATENTS

| | | | |
|---|---|---|---|
| 2,299,871 | 10/1942 | Baird | 75/171 |
| 2,469,718 | 5/1949 | Edlund et al. | 75/171 |
| 2,704,250 | 3/1955 | Payson | 75/171 |
| 3,346,378 | 10/1967 | Foster et al. | 75/171 |
| 3,362,816 | 1/1968 | Winter et al. | 75/171 |
| 3,393,999 | 7/1968 | Lherbier et al. | 75/171 |

*Primary Examiner*—L. Dewayne Rutledge
*Assistant Examiner*—E. L. Weise
*Attorney, Agent, or Firm*—Craig & Antonelli

[57] ABSTRACT

Solid-solution strengthened austenitic alloys consisting of, in weight percent, no more than 0.1 % carbon, from 4 (%C) to 1 % titanium and/or niobium (alone or in combination), no more than 75 % cobalt, no more than 26 % chromium, from 8 % to 40 % tungsten, wherein the amount of 1/5 (%Co) + (%Cr) + (%W) is in the range from 38 % to 46 %, with or without at least one element from the group consisting of no more than 0.1 % boron, no more than 0.5 % zirconium, no more than 0.5 % yttrium and no more than 1 % hafnium, and the balance essentially nickel except for impurities.

These alloys possess excellent high-temperature strength as well as good workability.

10 Claims, No Drawings

SOLID-SOLUTION STRENGTHENED AUSTENITIC ALLOYS

This invention relates to alloys having excellent high-temperature strength and good workability adapted for the material of the heat-exchangers for atomic energy iron-making process.

The material of the heat-exchangers for atomic energy iron-making process is required to have excellent high-temperature strength and good workability. Among conventional high-temperature materials, some of nickel-base precipitation hardened alloys or refractory metals such as molybdenum-base alloys have excellent high-temperature strength but they are inferior in workability while conventional iron-base or nickel-base solid-solution strengthened alloys have good workability in general but they are inferior in high-temperature strength, so that all these materials are not acceptable as the material of the heat-exchangers for atomic energy iron-making process.

The alloys of the present invention consist of, in weight percent, no more than 0.1 % carbon, from 4 (%C) to 1 % titanium and/or niobium (alone or in combination), no more than 75 % cobalt, no more than 26 % chromium, from 8 % to 40 % tungsten, wherein the amount of 1/5 (%Co) + (%Cr) + (%W) is in the range from 38 % to 46 %, with or without at least one element from the group consisting of no more than 0.1 % magnesium, no more than 0.1 % boron, no more than 0.5 % zirconium, no more than 0.5 % yttrium and no more than 1 % hafnium, and the balance essentially nickel except for impurities.

More preferable alloys of the present invention consist of, in weight percent, no more than 0.1 % carbon, from 4 (%C) to 1 % titanium and/or niobium (alone or in combination), from 25 % to 55 % cobalt, from 10 % to 22 % chromium, from 13 % to 25 % tungsten, wherein the amount of 1/5 (%Co) + (%Cr) + (%W) is in the range from 40 % to 44 %, with or without at least one element from the group consisting of no more than 0.05 % magnesium, no more than 0.02 % boron, no more than 0.2 % zirconium, no more than 0.2 % yttrium and no more than 0.5 % hafnium, and the balance essentially nickel.

The most preferably alloy of the present invention consists of about 0.05 % carbon, either 0.4 % titanium or 0.6 % niobium, 30 % cobalt, 16 % chromium, 20 % tungsten, 0.01 % magnesium, 0.05 % zirconium and the balance nickel.

The reason of the limitation of the composition is following:

As carbon forms MC type carbide combining with titanium or niobium and prevent grain growth, a little amount of carbon is necessary. However, carbon in excess of 0.1 % forms excessive amount of carbide and impairs hot-workability of the alloys. Therefore the amount of carbon is limited to no more than 0.1 %. As titanium and niobium form MC type carbide combining with carbon and prevent excessive grain growth, the minimum amount of titanium and/or niobium should be 4 (%C). On the other hand excessive amount of titanium and/or niobium causes structural instability in the alloys and so the maximum amount of titanium and/or niobium (alone or in combination) should be 1 %.

Cobalt reduces stacking fault energy and increases high-temperature strength of the alloys, so that the maximum content of cobalt may be 75 %, although it should be limited in connection with the contents of chromium and tungsten from the viewpoint of structural stability of the alloys. More preferable amount of cobalt is in the range from 25 % to 55 %.

Chromium lowers stacking fault energy and diffusion coefficient of the alloys, so that it increases high-temperature strength, and also it improves oxidation resistance of the alloy. Therefore chromium can be contained in the alloys up to 26 %, though the amount of chromium should be limited in connection with the amounts of cobalt and tungsten from the viewpoint of structural stability of the alloys. More preferable range of chromium content in the alloys of the present invention is from 10 % to 22 %.

Tungsten lowers stacking fault energy and especially diffusion coefficient and so increases high-temperature strength of the alloys. The minimum amount of tungsten should be 8 %, while the maximum content of tungsten could be 40 %, though the content of tungsten should be limited in connection with cobalt and chromium contents from the viewpoint of structural stability of the alloys. More preferable amount of tungsten is in the range from 13 % to 25 %.

The important point of the present invention is the limitation in the combination among the contents of cobalt, chromium and tungsten. Although each of these elements may increase high-temperature strength of the alloys up to certain amounts, all of them increase the average electron vacancy number of the alloys. When the electron vacancy number exceeds a given value, the structure of the alloy becomes unstable with attendant precipitation of adverse intermetallic compounds. Thus, there exists certain upper limit on the contents of these elements. The most important point of the present invention is the discovery that, if the amount of 1/5 (%Co) + (%Cr) + (%W) is kept within the range from 38 % to 46 %, there will be obtained an alloy having excellent high-temperature strength as well as good structural stability. In other words, the amount of 1/5 (%Co) + (%Cr) + (%W) needs to be more than 38 % for the alloys to have excellent high-temperature strength but less than 46 % for the alloys to have good structural stability. Therefore we set the range of the amount of 1/5 (%Co) + (%Cr) + (%W) from 38 % to 46 %. More preferable range thereof is from 40 % to 44 %. Further, the most preferable amount thereof is 42%. Table 1 shows some examples of the most preferable combinations of cobalt, chromium and tungsten contents.

Table 1

| | | | (%) |
|---|---|---|---|
| Co | Cr | W | 1/5 (%Co) + (%Cr) + (%W) |
| 10 | 8 | 32 | 42 |
| 10 | 12 | 28 | 42 |
| 10 | 16 | 24 | 42 |
| 10 | 20 | 20 | 42 |
| 20 | 24 | 14 | 42 |
| 30 | 4 | 32 | 42 |
| 30 | 8 | 28 | 42 |
| 30 | 12 | 24 | 42 |
| 30 | 16 | 20 | 42 |
| 30 | 20 | 16 | 42 |
| 40 | 20 | 14 | 42 |
| 40 | 24 | 10 | 42 |
| 50 | 4 | 28 | 42 |
| 50 | 8 | 24 | 42 |
| 50 | 12 | 20 | 42 |
| 50 | 16 | 16 | 42 |
| 60 | 20 | 10 | 42 |
| 70 | 4 | 24 | 42 |

Table 1-continued

| | | | (%) |
|---|---|---|---|
| Co | Cr | W | 1/5 (%Co) + (%Cr) + (%W) |
| 70 | 8 | 20 | 42 |
| 70 | 12 | 16 | 42 |
| 70 | 16 | 12 | 42 |

When an alloy is used at extremely high-temperature under stress, creep caused by grain boudary diffusion cannot be neglected. Accordingly the addition of alloying elements which suppress grain boundary diffusion is important to improve high-temperature strength of an alloy. The atomic arrangement at grain boundary is irregular and there exist a lot of voids along grain boundary, so that atomic diffusion occurs through such voids especially at high-temperature. Therefore it is desired to add such element that fill up the voids to decrease the rate of grain boundary diffusion. The atomic radii of such elements should be different from that of the elements which form matrix so that they seggregate preferablly along grain boundary. Magnesium, boron, zirconium, yttrium and hafnium are the elements that can seggregate preferablly along grain boundary if added in small amount because their solubilities to matrix are very small. The atomic radii of magnesium and boron are smaller than those of the elements that form matrix, while those of zirconium, yttrium and hafnium are larger, so that all these elements fill up the voids at grain boundary. However, if these elements are added in excess amount, they form intermetallic compounds and lower the melting point of the alloy. Therefore the amounts of magnesium, boron, zirconium, yttrium and hafnium are limited respectively to no more than 0.1 %, no more than 0.1 %, no more than 0.5 %, no more than 0.5 % and no more than 1 %. More preferable contents of magnesium, boron, zirconium, yyttrium and hafnium are respectively no more than 0.05 %, no more than 0.02 %, no more than 0.2 %, no more than 0.2 % and no more than 0.5 %.

Table 2

| | | | | | | | | | | | | | | | (Weight %) |
|---|---|---|---|---|---|---|---|---|---|---|---|---|---|---|---|
| | No. | C | Cr | Mo | W | Co | Al | Ti | $N_b$ | $F_e$ | Ni | Mg | B | Zr | Y |
| Alloy of the present invention | 1 | 0.03 | 20.1 | — | 15.6 | 29.1 | — | 0.15 | — | — | Bal | — | — | — | — |
| | 2 | 0.05 | 15.9 | — | 19.8 | 29.4 | — | 0.33 | — | — | Bal | — | — | — | — |
| | 3 | 0.05 | 12.0 | — | 23.9 | 29.0 | — | 0.37 | — | — | Bal | — | — | — | — |
| | 4 | 0.04 | 15.0 | — | 16.4 | 47.7 | — | 0.34 | — | — | Bal | — | — | — | — |
| | 5 | 0.05 | 15.8 | — | 20.0 | 30.5 | — | — | 0.77 | — | Bal | — | — | — | — |
| | 6 | 0.05 | 15.8 | — | 19.2 | 30.1 | — | 0.36 | — | — | Bal | 0.003 | — | — | — |
| | 7 | 0.04 | 15.9 | — | 19.6 | 30.2 | — | 0.49 | — | — | Bal | 0.003 | 0.013 | — | — |
| | 8 | 0.04 | 16.0 | — | 18.5 | 30.1 | — | 0.49 | — | — | Bal | 0.002 | — | 0.05 | — |
| | 9 | 0.06 | 15.6 | — | 19.8 | 28.8 | — | 0.38 | — | — | Bal | 0.003 | — | — | 0.05 |
| | 10 | 0.03 | 19.4 | — | 15.9 | 30.2 | — | 0.42 | — | — | Bal | 0.002 | — | — | — |
| | 11 | 0.06 | 20.3 | — | 13.9 | 30.3 | — | 0.48 | — | — | Bal | 0.004 | 0.015 | — | — |
| | 12 | 0.03 | 20.0 | — | 15.4 | 30.3 | — | 0.49 | — | — | Bal | 0.002 | — | 0.04 | — |
| | 13 | 0.04 | 19.9 | — | 16.3 | 29.8 | — | 0.28 | — | — | Bal | 0.002 | — | — | 0.08 |
| Experimental alloy | 14 | 0.03 | 19.8 | 9.8 | — | 29.5 | — | 0.30 | — | — | Bal | — | — | — | — |
| | 15 | 0.04 | 17.9 | 5.2 | 7.6 | 29.6 | — | 0.24 | — | — | Bal | — | — | — | — |
| Conventional alloy | 16 | 0.03 | 20.5 | 8.5 | — | 12.0 | 1.2 | 0.4 | — | — | Bal | — | — | — | — |
| | 17 | 0.05 | 20.0 | — | 4.6 | 9.2 | 0.3 | 0.3 | 1.0 | Bal | 39.7 | — | — | — | — |

Table 2 shows the chemical composition of the specimens that were used to compare the high-temperature strength of the alloys of the present invention with that of conventional commercial alloys. The alloy No. 16 is one of the strongest conventional nickel-base solid-solution strengthened alloys and the alloy No. 17 is one of the strongest conventional iron-base solid-solution alloys.

The specimens were prepared by hot-working to from 15 to 30 millimeters round or square bars and solution-treatment. The specimens of the alloys of the present invention and the experimental alloys are solution-treated by heating to 1225°C or 1250°C, holding 1 or 2 hours at that temperature and cooling in oil, while the specimens of conventional alloys are solution-treated in the respective standard solution-treating condition.

Table 3

| | | 5 kg/mm² | | | 4 kg/mm² | | |
|---|---|---|---|---|---|---|---|
| | No. | Rupture life (h) | Elongation (%) | Reduction (%) | Rupture life (h) | Elongation (%) | Reduction (%) |
| Alloy of the present invention | 1 | 43.8 | 25.0 | 21.4 | 116.1 | 16.7 | 18.5 |
| | 2 | 83.0 | 39.2 | 32.9 | 241.7 | 29.1 | 32.0 |
| | 3 | 72.0 | 51.3 | 42.3 | 165.4 | 47.5 | 51.8 |
| | 4 | 43.8 | 53.3 | 38.5 | 105.3 | 54.2 | 43.9 |
| | 5 | 63.7 | 26.0 | 23.4 | 122.5 | 31.5 | 29.0 |
| | 6 | 93.3 | 30.4 | 28.0 | 262.5 | 26.7 | 27.6 |
| | 7 | 140.3 | 50.9 | 41.6 | 296.9 | 29.2 | 30.0 |
| | 8 | 147.7 | 47.5 | 48.8 | 532.0 | 46.2 | 50.6 |
| | 9 | 43.6 | 35.4 | 33.0 | 103.8 | 30.5 | 20.0 |
| | 10 | 49.4 | 32.5 | 27.3 | 202.1 | 30.0 | 27.8 |
| | 11 | 135.0 | 40.8 | 45.8 | 339.7 | 23.3 | 36.2 |
| | 12 | 86.7 | 70.8 | 76.4 | 269.7 | 49.6 | 66.0 |
| | 13 | 48.1 | 31.7 | 30.4 | 147.6 | 29.2 | 25.0 |
| Experimental alloy | 14 | 14.8 | 31.0 | 26.1 | 31.8 | 26.3 | 26.1 |
| | 15 | 19.2 | 9.2 | 10.7 | 76.0 | 9.6 | 7.8 |
| Conventional alloy | 16 | 7.1 | 37.5 | 54.7 | 21.8 | 75.5 | 57.1 |
| | 17 | 4.2 | 50.8 | 55.0 | 10.5 | 27.8 | 31.8 |

Table 3 shows the results of stress-rupture test at 1000°C. As can be seen from this table, the alloys of the present invention possess extremely high stress-rupture strength as compared with the experimental alloys and the conventional alloys.

As has been described, there are obtained by the present invention solid-solution strengthened austenitic alloys having excellent high-temperature strength as well as good workability.

What is claimed is:

1. A solid-solution strengthened austenitic alloy having excellent high-temperature strength consisting essentially of, in weight percent, no more than 0.1 % carbon, from 4 (%C) to 1 % titanium and/or niobium (alone or in combination), from 25 % to 55 % cobalt, from 10 % to 22 % chromium, from 13 % to 25 % tungsten, wherein the amount of 1/5 (%Co) + (%Cr) + (%W) is in the range from 40 % to 44 %, and the balance nickel except for impurities, the amount of carbon being sufficient to form MC type carbides with the titanium and niobium.

2. A solid-solution strengthened austenitic alloy having excellent high-temperature strength consisting essentially of, in weight percent, no more than 0.1 % carbon, from 4 (%C) to 1 % titanium and/or niobium (alone or in combination), from 25 % to 55 % cobalt, from 10 % to 22 % chromium, from 13 % to 25 % tungsten, wherein the amount of 1/5 (%Co) + (%Cr) + (%W) is in the range from 40 % to 44%, at least one element selected from the group consisting of no more than 0.05 % magnesium, no more than 0.02 % boron, no more than 0.2 % yttrium and no more than 0.5 % hafnium, and the balance essentially nickel except for impurities, the amount of carbon being sufficient to form MC type carbides with the titanium and niobium, the amount of said at least one element being sufficient to suppress grain boundary diffusion at high temperature.

3. A solid-solution strengthened austenitic alloy having excellent high-temperature strength consisting of, in weight percent, about 0.05 % carbon, either about 0.4 % titanium or 0.6 % niobium, about 30 % cobalt, about 16 % chromium, about 20 % tungsten, about 0.01 % magnesium, about 0.05 % zirconium and the balance essentially nickel.

4. The alloy of claim 1, wherein said alloy consists of carbon, titanium and/or niobium, cobalt, chromium, tungsten, and nickel.

5. The alloy of claim 2, wherein said alloy consists of carbon, titanium and/or niobium, cobalt, chromium, tungsten, nickel and said at least one element.

6. The alloy of claim 3, wherein said alloy contains 0.4% titanium.

7. The alloy of claim 3, wherein said alloy contains 0.6% niobium.

8. The alloy of claim 2, wherein said alloy contains at least one element selected from the group consisting of no more than 0.05% magnesium, no more than 0.02% boron, no more than 0.2% zirconium, no more than 0.2% yttrium, and no more than 0.5% hafnium.

9. The alloy of claim 1, wherein said alloy contains about 21 to 35% nickel.

10. The alloy of claim 2, wherein said alloy contains about 21 to 35% nickel.

* * * * *